US010748520B2

(12) United States Patent
Trumpy et al.

(10) Patent No.: US 10,748,520 B2
(45) Date of Patent: Aug. 18, 2020

(54) METHOD AND APPARATUS FOR CONTROLLING VEHICLE SOUND IN A VEHICLE

(71) Applicant: Harman International Industries, Incorporated, Stamford, CT (US)

(72) Inventors: David Trumpy, Novi, MI (US); Divya Sishtla Venkata, Novi, MI (US); Santosh Adari, Novi, MI (US); Kevin J Bastyr, Novi, MI (US); Jens Dembinski, Novi, MI (US); Nicolas Pelle, Novi, MI (US); Prashanth Udumula, Novi, MI (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/377,984

(22) Filed: Apr. 8, 2019

(65) Prior Publication Data

US 2019/0311705 A1 Oct. 10, 2019

Related U.S. Application Data

(60) Provisional application No. 62/655,203, filed on Apr. 9, 2018.

(51) Int. Cl.
*G10K 11/178* (2006.01)
*G10K 15/02* (2006.01)

(52) U.S. Cl.
CPC ..... *G10K 11/178* (2013.01); *G10K 11/17883* (2018.01); *G10K 15/02* (2013.01);
(Continued)

(58) Field of Classification Search
CPC ..... G10K 11/178; G10K 11/17883; G10K 15/02; G10K 2210/1282; G10K 2210/51; H04R 2499/13
(Continued)

(56) References Cited

U.S. PATENT DOCUMENTS

2011/0280410 A1* 11/2011 Matono ..... G10K 11/178 381/71.1
2012/0130580 A1 5/2012 Omote
(Continued)

OTHER PUBLICATIONS

European Search Report for Application No. 19167548.9-1207, dated Aug. 12, 2019.

*Primary Examiner* — Norman Yu
(74) *Attorney, Agent, or Firm* — McCoy Russell LLP

(57) ABSTRACT

The present disclosure relates to systems and methods for active sound management for vehicles. In one embodiment, a process for active sound management for a vehicle includes determining vehicle operation state and powertrain operation for the vehicle, and detecting sound generated by the powertrain operation of the vehicle. A synthesized sound may be determined for output based on selection of at least one frequency of the sound generated by the powertrain to drive a frequency of a sine-wave generator, synthesizing an output wave file with pitch shifting of frequency based on powertrain operation, and blending sine-wave generator output with the synthesized wave file to cancel unwanted powertrain noise and generate desired sounds for vehicles. Output of the synthesized sound may be controlled to provide simultaneous cancellation and synthesis in at least one same frequency range.

20 Claims, 4 Drawing Sheets

(52) U.S. Cl.
CPC . *G10K 2210/1282* (2013.01); *G10K 2210/51* (2013.01); *H04R 2499/13* (2013.01)

(58) Field of Classification Search
USPC ..... 381/58, 59, 71.2, 71.4, 71.8, 86, 381/94.1–94.3, 98, 100, 365
See application file for complete search history.

(56) References Cited

U.S. PATENT DOCUMENTS

| | | | | |
|---|---|---|---|---|
| 2014/0228078 | A1 | 8/2014 | Weber | |
| 2015/0170629 | A1* | 6/2015 | Christoph ..... | G10K 15/02 381/61 |
| 2015/0197195 | A1 | 7/2015 | Hera | |
| 2016/0284334 | A1 | 9/2016 | Hera | |

* cited by examiner

METHOD AND APPARATUS FOR CONTROLLING VEHICLE SOUND IN A VEHICLE

CROSS-REFERENCE TO RELATED APPLICATION

This application claims priority to U.S. Provisional Application No. 62/655,203 filed on Apr. 9, 2018 and titled METHOD AND APPARATUS FOR CONTROLLING VEHICLE SOUND IN A VEHICLE, the content of which is expressly incorporated by reference in its entirety.

FIELD

The present disclosure relates to electronic sound synthesis and active noise cancelation, and more particularly to internal electronic sound synthesis for vehicles.

BACKGROUND

There exists a need for improved acoustic noise management in vehicles. Operation of vehicles including single or mixed powertrains can result in noise generated by the vehicle. In some cases, the noise generated by the vehicle results in non-uniform noise to an operator or passenger. Vehicle noise may be distracting or present an annoyance to the vehicle passengers. In addition, different operating states may result in noise generated by the vehicle at different times. There additionally exists a need for improved internal electronic sound synthesis in vehicles and for vehicles having hybrid drivetrains.

BRIEF SUMMARY OF THE EMBODIMENTS

Disclosed and claimed herein are systems and methods for active sound management for a vehicle. In one embodiment, method includes determining, by a control device, vehicle operation state and powertrain operation for the vehicle, and detecting, by the control device, sound generated by the powertrain operation of the vehicle. The method also includes determining, by the control device, a synthesized sound for output based on selection of at least one frequency of the sound generated by the powertrain to drive a frequency of a sine-wave generator, synthesizing an output wave file with pitch shifting of frequency based on powertrain operation, and blending sine-wave generator output with the synthesized wave file to cancel unwanted powertrain noise and generate desired sounds for vehicles. The method also includes controlling, by the control device, output of the synthesized sound, wherein output of the synthesized sound provides simultaneous cancellation and synthesis in at least one same frequency range.

In one embodiment, vehicle operating states include off, park, drive, and reverse, and the powertrain operations include operation of combustion engine, electric power, and combination of combustion engine and electric power.

In one embodiment, detecting sound generated by the powertrain includes determining at least one frequency generated by a combustion engine of the vehicle.

In one embodiment, selection of at least one frequency is performed by a sound frequency control unit, sound frequency control unit, a localization unit, an engine order cancellation (EOC) unit, and road noise cancelation (RNC) unit to maximize engine order cancellation.

In one embodiment, synthesizing an output wave file includes wave based synthesis by table based pitch shifting of wave files between the input signal and a pitch control rate for internal electronic sound synthesis (iESS).

In one embodiment, blending sine-wave generator output with the synthesized wave file includes generating a sound for each vehicle operating mode and powertrain operation, and blending transitions sound output for each mode and operation.

In one embodiment, simultaneous cancellation and synthesis in at least one frequency range is provided by canceling noise for at least one selected frequency.

In one embodiment, controlling output of the synthesized sound includes pitch shifting to create at least one of a natural increase and decrease of sound.

In one embodiment, controlling output of the synthesized sound includes randomization of a synthesized wave to ensure non-repetition of sound output.

In one embodiment, controlling output of the synthesized sound includes controlling a variance of a randomizer relative to speed for control of sound randomization characteristics.

Another embodiment is directed to a system for active sound management for a vehicle by a control device control device. The system includes an input configured to receive vehicle information and sound generated by the vehicle, an output configured to output a synthesized sound, and a controller coupled to the input and output. The controller is configured to determine vehicle operation state and powertrain operation for the vehicle, and detect sound generated by the powertrain operation of the vehicle. The controller is configured to determine a synthesized sound for output based on selection of at least one frequency of the sound generated by the powertrain to drive a frequency of a sine-wave generator, synthesizing an output wave file with pitch shifting of frequency based on powertrain operation, and blending sine-wave generator output with the synthesized wave file to cancel unwanted powertrain noise and generate desired sounds for vehicles. The controller is configured to control output of the synthesized sound, wherein output of the synthesized sound provides simultaneous cancellation and synthesis in at least one same frequency range.

In one embodiment, controlling output of the synthesized sound includes randomization of a synthesized wave to ensure non-repetition of sound output, and controlling a variance of a randomizer relative to speed for control of sound randomization characteristics.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

Figure 1:
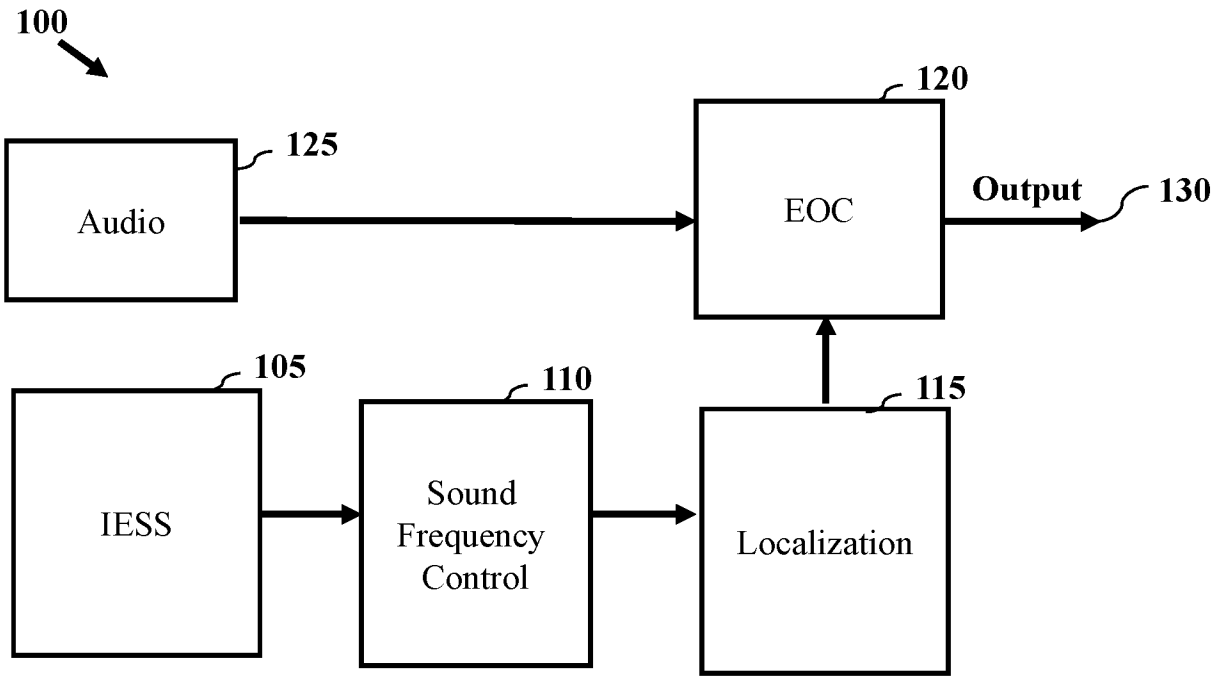
FIG. 1 depicts graphical representation of a system according to one or more embodiments.

One aspect of the disclosure is directed to internal electronic sound synthesis for vehicles. In one embodiment, a system is provided to determine and output one or more sounds within a vehicle. Another embodiment is directed to methods for synthesizing sounds that allows for vehicle operation to be accounted for. Other embodiments are directed to sound synthesis for vehicles having different power train sources.

One embodiment of the disclosure is directed to a digital signal processing system for cancelling unwanted powertrain noise and synthesizing desired sounds for vehicles. Embodiments described herein may be configured for vehicles having multiple powertrain modes, such as hybrid vehicles. Another embodiment is directed to integrating vehicle control signals to the various points of a signal processing chain to create a cohesive sound as if a single powertrain is operating a vehicle under all powertrain modes.

In one embodiment, an acoustic noise management system is provided for a vehicle. The system may include functional blocks for internal electronic sound synthesis (iESS), sound frequency control unit (e.g., Hybrid Control), a localization unit, an engine order cancellation (EOC) unit, and road noise cancelation (RNC) unit. The system may be configured to address auditory feedback to vehicle passengers by a powertrain that alternates between one of several modes. As such the system can correct for noises that may be very uncomfortable to passengers of a vehicle. In one embodiment, the system may provide multiple modes of operation including: off, pure electric, combustion, fuel-cell, or a combination thereof.

According to one embodiment of the disclosure, systems and processes are provided for internal electronic sound synthesis (iESS) for an order based sound synthesis. In one embodiment, sinusoidal synthesis may be provided where frequency of the oscillators can be driven by multiple sources. This can allow for vehicle speed, or other references in the vehicle, to be used to create sound. In one embodiment, frequency of order generators can have an offset frequency in Hz. This is to handle relating frequency to a parameter such as speed that can have a 0 value. Various gain tables may be employed to control the relationship of the magnitude of individual or overall oscillators to one or more vehicle control signals.

According to one embodiment, systems and processes are provided for internal electronic sound synthesis (iESS) configured for vehicles with non-conventional powertrains (i.e. electric, hybrid electric/internal combustion (IC)). The configurations can correct for inconsistent sound feedback to the driver. Configurations can also provide sounds that passengers have become accustom to (e.g., sounds made by internal combustion engines).

According to one embodiment, systems and processes described herein can determine vehicle operation and conditions to synthesize sounds for output in the vehicle. By way of example, sounds may be synthesized for a vehicle associated to replicate sounds associated with an internal combustion engine. These sounds may be generated and synthesized for a vehicle that includes a power train with multiple power drives. By way of example, sound synthesis as described herein can detect vehicle operation associated with hybrid vehicle, and output sounds for the hybrid vehicle which simulates sounds of a vehicle within an internal combustion engine. By way further example, sounds may be generated for the vehicle for periods of operation such as startup and shut down which resemble sounds during ignition and shut off of a gas engine vehicle. According to another embodiment, sounds may be generated and layered based on changes in multiple power train operation by one or more components described herein.

Examples of sound synthesis for vehicle operations may include generating sounds to resemble internal combustion engine operation and smooth transition for multiple power train elements. In one embodiment, sound synthesis is configured to provide noise associated with an engine starting sound after the ignition is turned. In many hybrid vehicles, no sound is heard and thus there is no auditory feedback that the vehicle is running. Another type of power train operation for sound synthesis includes the sound of engine noise increasing in volume as the vehicle accelerates. In a hybrid vehicle, the vehicle power train may be quiet when accelerating during periods where tine internal combustion engine is off. The internal combustion engine will make noise only under high load or battery charging events. Another type of power train operation for sound synthesis includes the sound of engine noise decreasing as load decreases. Here the internal combustion engine makes noise only under high load or battery charging events. In yet another embodiment, sound may be synthesized when the engine turns off, such that the sound disappears. In a hybrid vehicle there is no sound when the vehicle is stopped. No different auditory indication that the vehicle is off.

Configurations for sound synthesis may also be provided to provide sound synthesis and active noise control solutions with regard to generating sound for vehicles where the powertrain has multiple modes. In addition, sound synthesis solutions are provided to make noise in addition to when Engine RPM is within a range and during pure electric vehicle operation when electric motor rpm and/or speed are within a range.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

FIG. 1 depicts graphical representation of a system according to one or more embodiments. According to one embodiment, an acoustic noise management system is provided for use vehicles. System 100 includes internal electronic sound synthesis (iESS) unit 105, sound frequency control unit 110, localization unit 115 and engine order cancelation (EOC) unit 120. Components of system 100 may be configured to enhance driving experience by actively managing noise and sound inside and outside a vehicle. iESS unit 105 may be configured to generate one or more sounds associated with vehicle operation. Sound frequency control unit 110 may be configured to control the output levels for sounds generated within the vehicle. Localization unit 115 may control the sound output in the vehicle, such as controlling sound to be output to one or more portions of the vehicle.

In one embodiment, the audio signal for entertainment is added to the localized output of iESS unit 105. This signal enters the EOC unit 120 to act as a reference for noise that should not be canceled. A cancellation signal is added to iESS unit 105 and audio, and then sent out to the vehicle system. EOC unit 120 also inputs microphone signals.

EOC unit 120 may be configured to output sound to cancel noise generated by the vehicle, such as audio 125, and audio via output 130 to one or more speakers. System may be configured to output sound for active noise control in vehicles with non-conventional powertrains (i.e. electric, hybrid electric/internal combustion (IC)).

Systems and configurations discussed herein allow for acoustical transition between any combination of these 5 states that a typical hybrid vehicle can be in, including 1) Gas Engine under Load, 2) both motors on with Gas engine charging battery, perhaps at a fixed RPM, 3) Both motors on with Gas Engine driving wheels, 4) Electric Motor only and 5) Both Motors off. In one embodiment, several actions are possible when the vehicle is in each of these 5 steady state conditions. Acoustic noise generation may be for transitioning and maintain sound during the 5 states including high frequency electric motor whine cancellation, simulated engine sound that tracks wheel rpm, simulated engine sound that mimics gas engine idle sound and replacing beeping when transmission is in reverse.

According to one embodiment, an engine order cancelation may be performed to cancel engine noise maximally, at all times. In one embodiment, then a desired balance of engine orders may be created (by sampling an engine and perhaps augmenting certain orders) and the created signal may be combined with some type of noise, or engine sampled sound between the orders. In another embodiment, a sampled or synthesized audio file (e.g., .WAV file) of the desired engine sound (that may not sound like an engine at all), may be generated. The audio system may output a scaled or a "fake" RPM sound based input from the accelerator pedal, torque output, and wheel rpm (which is essentially vehicle speed) and not shaft RPM. The engine noise may be generated when the torque and shaft RPM are correlated to changes in the wheel speed, and cross-fade this audio output with one of the options above when the torque and shaft RPM are not correlated to changes in the wheel speed. This can optimally include synthesizing a synthetic engine idle sound so operators know that the vehicle is powered on.

Figure 2:
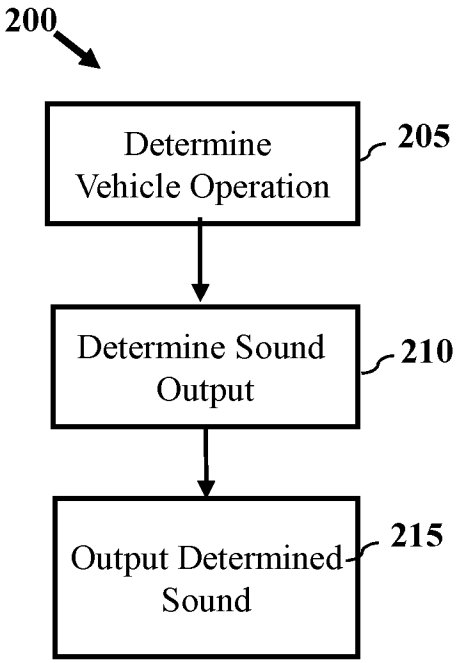
FIG. 2 depicts a process according to one or more embodiments.

FIG. 2 depicts a process according to one or more embodiments. Process 200 may be performed by a vehicle device for active notice management according to one or more embodiments. Process 200 may perform active sound management for a vehicle. According to one embodiment, process 200 includes determining vehicle operation at block 205. Vehicle operation may determine the speed of the vehicle, acceleration, and other operation characteristics regardless of when the can system of the vehicle provides an indication of which vehicle drive element is in operation. If a vehicle operating mode is not readily available, process 200 may be configured to deduce the mode from information associated with individual powertrain components received by the module.

In one embodiment, a vehicle operation state and powertrain operation for the vehicle are determined at block 205. In one embodiment, vehicle operating states include off, park, drive, and reverse, and the powertrain operations include operation of combustion engine, electric power, and combination of combustion engine and electric power. Sound generated by the powertrain operation, such as engine noise and electric drive noise, of the vehicle may also be determined at block 205. In one embodiment, detecting sound generated by the powertrain includes determining at least one frequency generated by a combustion engine of the vehicle.

Process 200 may determine sound output at block at block 210. According to one embodiment, turning a vehicles power drive elements on and off may result in non-uniform sound. For example, a vehicle having an electric drive and internal combustion engine may drive initially with little to no noise followed by noise generated when the internal combustion engine turns on. Sound synthesis may provide a single type of sound for the vehicle regardless of the vehicle power drive element employed based on the vehicle operation.

At block 210, process 200 determines a synthesized sound for output based on selection of at least one frequency of the sound generated by the powertrain to drive a frequency of a sine-wave generator, synthesizing an output wave file with pitch shifting of frequency based on powertrain operation, and blending sine-wave generator output with the synthesized wave file to cancel unwanted powertrain noise and generate desired sounds for vehicles.

In one embodiment, selection of at least one frequency is performed by a sound frequency control unit, sound frequency control unit, a localization unit, an engine order cancellation (EOC) unit, and road noise cancelation (RNC) unit to maximize engine order cancellation. According to another embodiment, synthesizing an output wave file includes wave based synthesis by table based pitch shifting of wave files between the input signal and a pitch control rate for internal electronic sound synthesis (iESS). In one embodiment, blending sine-wave generator output with the synthesized wave file includes generating a sound for each vehicle operating mode and powertrain operation, and blending transitions sound output for each mode and operation. In one embodiment, simultaneous cancellation and synthesis in at least one frequency range is provided by canceling noise for at least one selected frequency.

At block 215, determined sound is output for the vehicle. Sound may be output in an active fashion, wherein the sound is localized to the position of the vehicle. Sound may be output to add noise and cancel noise from one or more sources of the vehicle. Output of the synthesized sound may be controlled to provide simultaneous cancellation and synthesis in at least one same frequency range. In one embodiment, controlling output of the synthesized sound includes pitch shifting to create at least one of a natural increase and decrease of sound. In one embodiment, controlling output of the synthesized sound includes randomization of a synthesized wave to ensure non-repetition of sound output. In one embodiment, controlling output of the synthesized sound includes controlling a variance of a randomizer relative to speed for control of sound randomization characteristics. In one embodiment, controlling output of the synthesized sound includes randomization of a synthesized wave to ensure non-repetition of sound output, and controlling a variance of a randomizer relative to speed for control of sound randomization characteristics.

Figure 3:
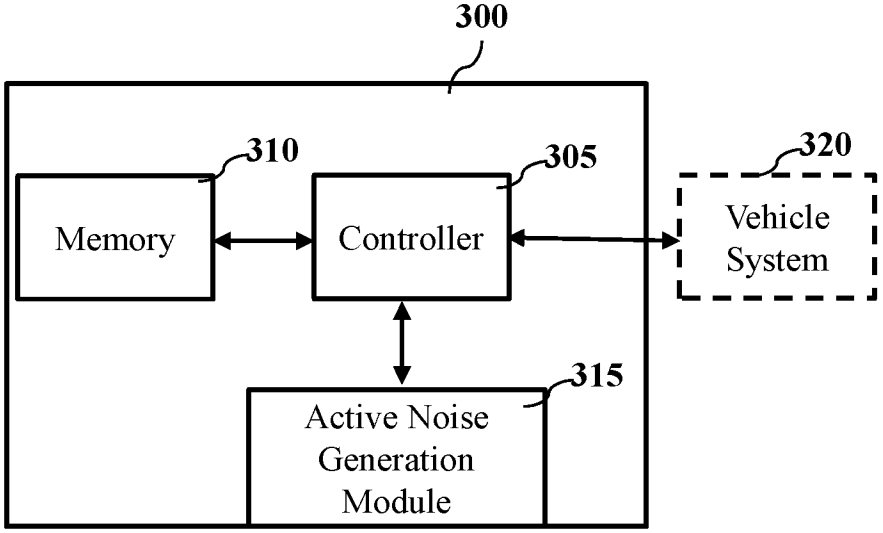
FIG. 3 depicts a graphical representation of a control device according to one or more embodiments.

FIG. 3 depicts a graphical representation of a control device according to one or more embodiments. According to one embodiment, a control device may relate to an electronic device for active noise management in a vehicle. Device 300 is a representation of a control device according to one or more embodiments.

According to one embodiment, device 300 includes controller 305, memory 310 and active noise generation module 315. Controller 305 may relate to a processor or control device configured to direct operation of the device. Memory 310 provides non-transitory storage for operational code of device 300 which is executable by controller 305. Controller 305 may include functional blocks for internal electronic sound synthesis (iESS), sound frequency control unit (e.g., Hybrid Control), a localization unit, an engine order cancellation (EOC) unit, and road noise cancelation (RNC) unit. Control interface 310 may include one or more control elements of device.

Output of device 300 may be provided to a vehicle system 320. In certain embodiments controller 305 may communication with vehicle system 320 for noise generation by active noise generation module 315. According to one embodiment, controller 305 includes an input and output relative to vehicle system 320. The input on controller 305 is configured to receive vehicle information and sound generated by the vehicle, and the output of controller 305 can output a synthesized sound. Controller 305 is coupled to the input and output and is configured to determine vehicle operation state and powertrain operation for the vehicle, and detect sound generated by the powertrain operation of the vehicle. Controller 305 may be for an acoustic noise management system and can address auditory feedback to vehicle passengers by a powertrain that alternates between one of several modes including: off, pure electric, combustion, fuel-cell, or a combination thereof. Controller 305 is configured to determine a synthesized sound for output based on selection of at least one frequency of the sound generated by the powertrain to drive a frequency of a sine-wave generator, synthesizing an output wave file with pitch shifting of frequency based on powertrain operation, and blending sine-wave generator output with the synthesized wave file to cancel unwanted powertrain noise and generate desired sounds for vehicles. Controller 305 is configured to control output of the synthesized sound, wherein output of the synthesized sound provides simultaneous cancellation and synthesis in at least one same frequency range. Controller 305 may be to include a sound frequency control unit, sound frequency control unit (e.g., Hybrid Control), a localization unit, an engine order cancellation (EOC) unit, and road noise cancelation (RNC) unit to maximize engine order cancellation.

Figure 4:
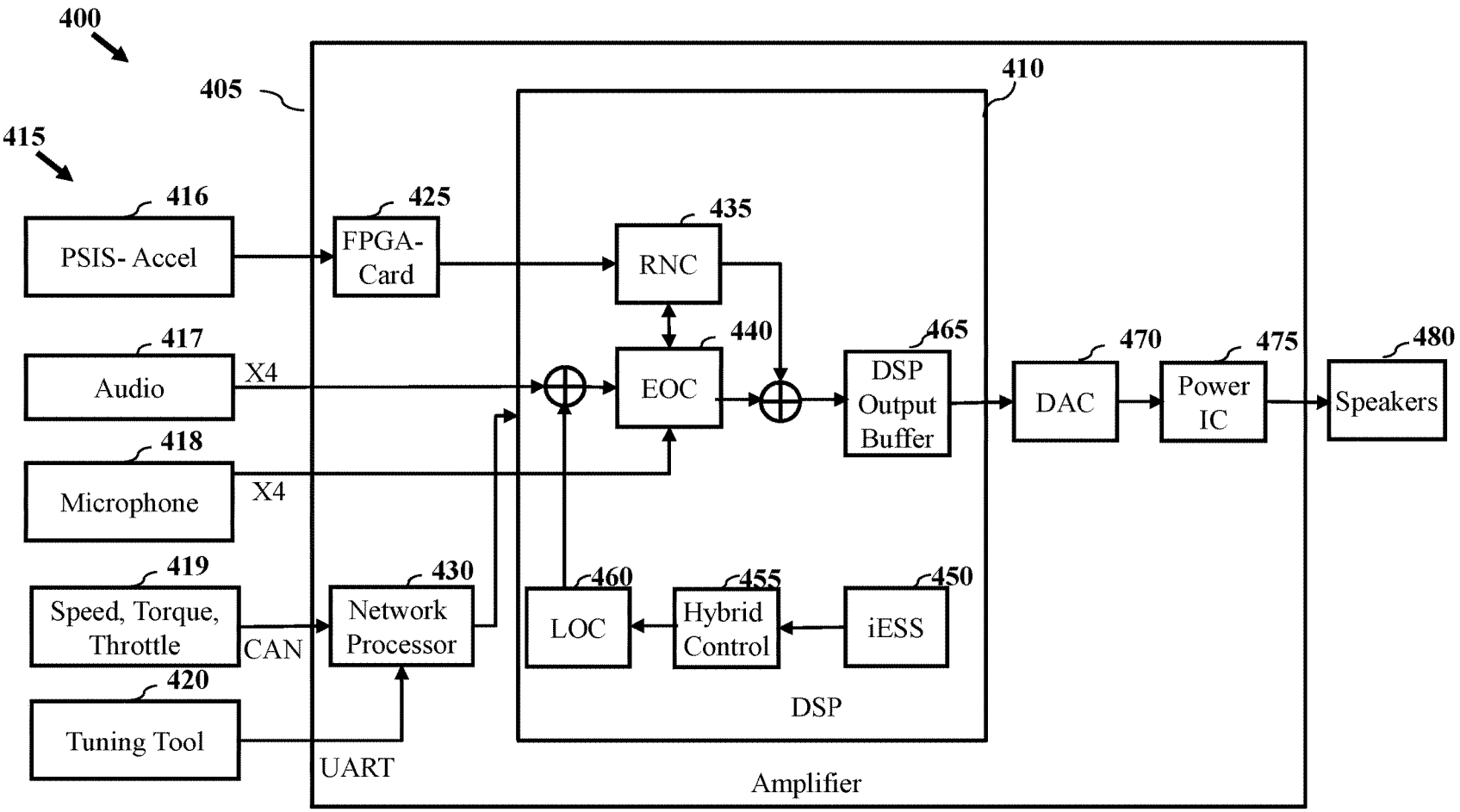
FIG. 4 depicts a graphical representation of a system according to one or more embodiments.

FIG. 4 depicts a graphical representation of a system according to one or more embodiments. System 400 includes amplifier 405 which may be configured to provide active noise management as discussed herein. Amplifier 405 includes a controller 410 (e.g., Digital signal processor) to perform one or more functions described herein.

According to one embodiment, amplifier includes an iESS unit 450 or module to perform order based synthesis of one or more sounds. In one embodiment, sound synthesis may be based on sinusoidal synthesis using one or more oscillators. The frequency of the oscillators can be driven by multiple sources. This allows speed or other references in the vehicle to be used to create sound. Frequency of order generators can have an offset frequency in Hz. This is to handle relating frequency to a parameter such as speed that can have a 0 value. Various gain tables control the relationship of the magnitude of individual or overall oscillators to one or more vehicle control signals.

Amplifier 410 may receive input shown as 415. Inputs 415 may include vehicle acceleration (e.g., accelerometer) data 416, audio data 417, microphone input 418, speed, torque and throttle data 419 via a Can bus, and a tuning tool 420 to modify sound generated. Accelerometer data 416 may include Peripheral Sensor Interface for Automotive Applications (PSIS), analog, A2B, or other digital interface and may be processed by field programmable gate array (FPGA) card 425 (e.g., integrated circuit). A network processer 430 may feed input data for the controller 410. Controller 410 includes an iESS unit 450, hybrid control unit 455, and a localization unit 460 to feed the EOC 440 that provides output to a DSP output buffer 465.

Controller 410 includes a localization unit 460 to place the powertrain noise where it would be expected. Controller 410 includes an EOC unit 440 that is activated whenever a powertrain is active that has strong narrowband noise. Controller 410 includes a RNC unit 435 to provide a broad band noise cancellation algorithm that can be used to cancel structural vibration related noise caused by multiple sources (powertrain, road noise, etc.). In one embodiment, RNC unit 435 receives peripheral sensor interface data from FPGA card 425. According to one embodiment, output of EOC unit 440 and RNC unit 435 are blended and output by DSP output buffer 465 to provide output sound by controller 410. Amplifier 405 may include a digital to analog converter 470 and power integrated circuit (IC) 475 to boost signal gain for output to speakers 480, which can include one or more speakers.

Figure 5:
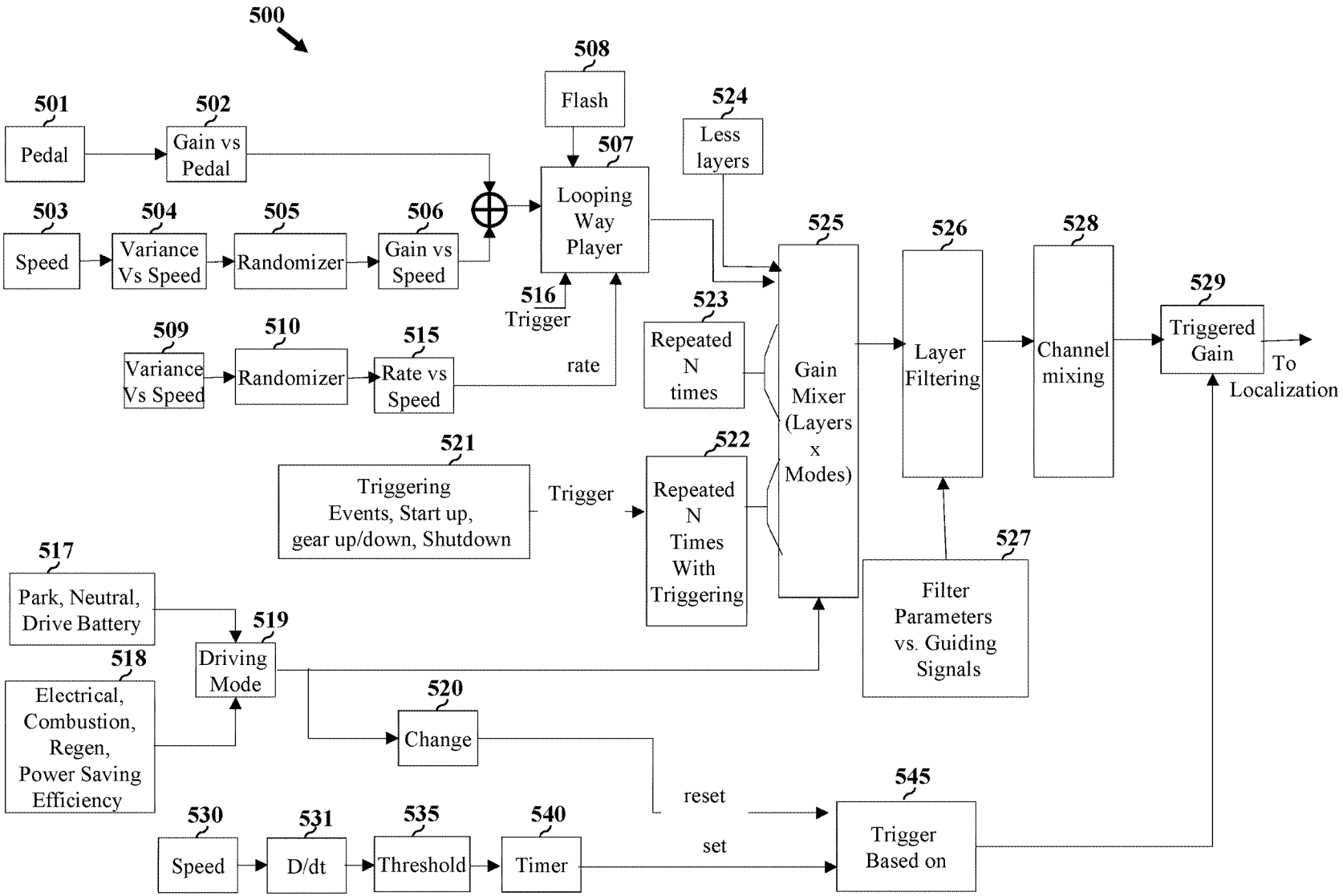
FIG. 5 depicts a graphical representation of system operation according to one or more embodiments.

FIG. 5 depicts a graphical representation of system operations according to one or more embodiments. System 500 is configured to provide active noise management. According to one embodiment, system 500 adds iESS to hybrid sound generators, mixes different synthesis methods based on vehicle mode, randomizes control signals to reduce repetitiveness, provides way synthesis triggered based on powertrain or user controlled events, and allows for features for handling steady state conditions (different patent application).

System 500 is configured for sound layers that can also include of banks of oscillators that include modulation, where guiding signals control the depth and frequency of modulation. In one embodiment, system 500 provides sinusoidal based Synthesis. Unlike systems that use pre-determined vehicle signals to drive the frequency of the sine-wave generators, system 550 allows for selection of vehicle signals during tuning. The magnitude of individual or overall oscillators may be based on one or more vehicle control signals According to one embodiment, pedal position may be determined at block 501 and a gain vs. pedal position table at block 502 can determine the magnitude of individual or overall oscillators to one or more vehicle control signals. Similarly, vehicle speed may be determined at block 503 and a variance (e.g., sound variance) vs. speed position table at block 504 can determine the magnitude of a sound signal. Randomizer at block 505 can introduce components to the sound and a gain vs. speed table at block 506 can generate sound waves based on vehicle speed. Looping way player 507 balances output based on pedal position at block 501 and speed at block 503, as well as output of gain vs. pedal position table at block 502 and gain vs. speed table at block 506. Looping way player 507 may receive flash memory input at block 508 for generating sound waves. As such sound synthesis may be provided for a vehicle based on vehicle operation status.

According to one embodiment, a variance vs. speed table at block 509 and a randomizer operation at block 510 can be output to a rate vs. speed table at block 515 to output a sounds rate to looping way player 507. One or more triggers (shown as 516) may activate or enable output by looping way player 507 and in some cases trigger selection of one or more sounds from flash memory 508. In one embodiment, system 500 provides wave based synthesis. In contrast to pitch shifting of way files using a fixed ratio through-out the control range, system 550 allows for table based or flexible equation between the input signal and the pitch control rate.

According to one embodiment, looping way player 507 outputs sound wave data to gain mixer 525. In some embodiments, a determination for less layers at block 524 is fed to gain mixer 525 to reduce the layers of sound output. Block 523 can output a control signal for repeated pattern length. System 500 is configured for randomization to ensure that a sound never repeats. Controlling the variance of the randomizer vs speed or other parameter provides the ability to change the random characteristics. One example would be to increase the randomness at idle to catch the attention of the driver with a powerful sound. System 500 may include detecting triggering events at block 521 for one or more of startup, gear changes (e.g., up/down), shutdown, etc.).

According to one embodiment, system 500 includes determining power train operation. Powertrain state, such as park, neutral, drive, and battery power may be determined at block 517. Powertrain operation mode, such as electrical power, combustion engine power, regeneration, power saving/efficiency, and a combination of electrical and combustion power, may be determined at block 518. A driving mode is determined at block 519 based on the power train operation determined at block 517 and power train operation mode determined at block 518. Driving mode may be provided to gain mixer 525 for sound selection.

According to one embodiment, vehicle operation status, such as speed, acceleration, may control the gain of sound output and to trigger the gain of a synthesized sound. At block 530, vehicle speed is determined and at block 531 vehicle acceleration is determined. At block 535, threshold ranges are used asses gain required. At block 540 a timer operation is provided to measure the duration of vehicle operation characteristics in order to determine sound output. Timer 540 can set a triggering at block 545. Changes to power train operation may be detected at block 520 to reset trigger block 545. System 500 is configured to allow for operation while the vehicle is stationary, and for layer blending based on mode provides unique sound for Off, Park, Drive (i.e. the vehicle is ready to go). Accordingly, triggering at block 545 may be based on one or more of driving conditions, and power train operation state.

System 500 is configured for operation while driving, such that layer blending based on powertrain status provides the ability to blend sound. For example, during electric drive, some noise from the IC engine may be missing. This sound character comprises one layer, which plays during this mode. Gain mixer 525 generates one or more sound layers per mode. Layer filtering at block 526 selects one or more sound layers based on input from block 527 providing filter parameters and guiding signals. In one embodiment, system 500 provides blending of sinusoidal and wave synthesis. Unlike use of a simple addition of the signals, system 550 allows for management based on vehicle operating mode (PRNDL) and powertrain operating (IC, electric, both).

In certain embodiments, engine order cancelation may be provided by selection of particular frequencies. At block 528, channel mixing is provided to mix synthesized sounds and engine order cancellation noise. In one embodiment, system 500 provides achieving simultaneous cancellation and synthesis in the same frequency range. Existing systems prevent overlapping frequency ranges for sound synthesis and engine order cancellation. System 550 allows for canceling to the levels specified by the synthesis portions. Triggered gain at block 529 controls the output of sound to one or more localized points of the vehicle.

System 500 is configured for way synthesis to provide flexibility that sound design can contain very complex sounds. System 500 is configured for pitch shifting to create the natural increase/decrease in frequency as would be expected from traditional powertrains.

While this disclosure has been particularly shown and described with references to exemplary embodiments thereof, it will be understood by those skilled in the art that various changes in form and details may be made therein without departing from the scope of the claimed embodiments.

What is claimed is:

1. A method for active sound management for a vehicle by a control device of the vehicle, the method comprising:

determining, by a control device, vehicle operation state and powertrain operation for the vehicle;

detecting, by the control device, sound generated by the powertrain operation of the vehicle;

determining, by the control device, a synthesized sound for output based on selection of at least one frequency of the sound generated by the powertrain to drive a frequency of a sine-wave generator, synthesizing an output wave file with pitch shifting of frequency based on powertrain operation, and blending sine-wave generator output with the synthesized wave file to cancel unwanted powertrain noise and generate desired sounds for vehicles; and controlling, by the control device, output of the synthesized sound, wherein output of the synthesized sound provides simultaneous cancellation and synthesis in at least one same frequency range.

2. The method of claim 1, wherein vehicle operating states include off, park, drive, and reverse, and the powertrain operations include operation of combustion engine, electric power, and combination of combustion engine and electric power.

3. The method of claim 1, wherein detecting sound generated by the powertrain includes determining at least one frequency generated by a combustion engine of the vehicle.

4. The method of claim 1, wherein selection of at least one frequency is performed by a sound frequency control unit, sound frequency control unit, a localization unit, an engine order cancellation (EOC) unit, and road noise cancelation (RNC) unit to maximize engine order cancellation.

5. The method of claim 1, wherein synthesizing an output wave file includes wave based synthesis by table based pitch shifting of wave files between the input signal and a pitch control rate for internal electronic sound synthesis (iESS).

6. The method of claim 1, wherein blending sine-wave generator output with the synthesized wave file includes generating a sound for each vehicle operating mode and powertrain operation, and blending transitions sound output for each mode and operation.

7. The method of claim 1, wherein simultaneous cancellation and synthesis in at least one frequency range is provided by canceling noise for at least one selected frequency.

8. The method of claim 1, wherein controlling output of the synthesized sound includes pitch shifting to create at least one of a natural increase and decrease of sound.

9. The method of claim 1, wherein controlling output of the synthesized sound includes randomization of a synthesized wave to ensure non-repetition of sound output.

10. The method of claim 1, wherein controlling output of the synthesized sound includes controlling a variance of a randomizer relative to speed for control of sound randomization characteristics.

11. A system for active sound management for a vehicle by a control device control device comprising:

an input configured to receive vehicle information and sound generated by the vehicle;

an output configured to output a synthesized sound; and a controller coupled to the input and output, the controller configured to determine vehicle operation state and powertrain operation for the vehicle;

detect sound generated by the powertrain operation of the vehicle;

determine a synthesized sound for output based on selection of at least one frequency of the sound generated by the powertrain to drive a frequency of a sine-wave generator, synthesizing an output wave file with pitch shifting of frequency based on powertrain operation, and blending sine-wave generator output with the synthesized wave file to cancel unwanted powertrain noise and generate desired sounds for vehicles; and control output of the synthesized sound, wherein output of the synthesized sound provides simultaneous cancellation and synthesis in at least one same frequency range.

12. The system of claim 11, wherein vehicle operating states include off, park, drive, and reverse, and the powertrain operations include operation of combustion engine, electric power, and combination of combustion engine and electric power.

13. The system of claim 11, wherein detecting sound generated by the powertrain includes determining at least one frequency generated by a combustion engine of the vehicle.

14. The system of claim 11, wherein selection of at least one frequency is performed by a sound frequency control unit, sound frequency control unit, a localization unit, an engine order cancellation (EOC) unit, and road noise cancelation (RNC) unit to maximize engine order cancellation.

15. The system of claim 11, wherein synthesizing an output wave file includes wave based synthesis by table based pitch shifting of wave files between the input signal and a pitch control rate for internal electronic sound synthesis (iESS).

16. The system of claim 11, wherein output of synthesized sound is based on sinusoidal synthesis using one or more oscillators.

17. The system of claim 11, wherein blending sine-wave generator output with the synthesized wave file includes generating a sound for each vehicle operating mode and powertrain operation, and blending transitions sound output for each mode and operation.

18. The system of claim 11, wherein simultaneous cancellation and synthesis in at least one frequency range is provided by canceling noise for at least one selected frequency.

19. The system of claim 11, wherein controlling output of the synthesized sound includes pitch shifting to create at least one of a natural increase and decrease of output sound.

20. The system of claim 11, wherein controlling output of the synthesized sound includes randomization of a synthesized wave to ensure non-repetition of sound output, and controlling a variance of a randomizer relative to speed for control of sound randomization characteristics.

* * * * *